US010494890B2

(12) United States Patent
van der Zwet

(10) Patent No.: US 10,494,890 B2
(45) Date of Patent: Dec. 3, 2019

(54) MULTI-LEVEL DECK SYSTEM FOR BLOWOUT PREVENTERS

(71) Applicant: Schlumberger Technology Corporation, Sugar Land, TX (US)

(72) Inventor: Thomas van der Zwet, Tomball, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 249 days.

(21) Appl. No.: 15/476,579

(22) Filed: Mar. 31, 2017

(65) Prior Publication Data

US 2018/0283110 A1 Oct. 4, 2018

(51) Int. Cl.

| | |
|---|---|
| ***E21B 33/06*** | (2006.01) |
| ***E04G 1/36*** | (2006.01) |
| ***E04G 3/24*** | (2006.01) |
| ***E04G 3/28*** | (2006.01) |
| ***E21B 41/00*** | (2006.01) |
| ***E21B 19/00*** | (2006.01) |
| ***E04G 5/00*** | (2006.01) |

(52) U.S. Cl.

CPC ..... *E21B 33/061* (2013.01); *E04G 1/36* (2013.01); *E04G 3/24* (2013.01); *E04G 3/28* (2013.01); *E21B 19/00* (2013.01); *E21B 41/00* (2013.01); *E04G 2005/008* (2013.01)

(58) Field of Classification Search

CPC ..... E21B 33/06; E21B 33/061; E21B 33/062; E21B 33/063; E21B 33/064; E21B 19/00; E04G 1/36; E04G 1/362; E04G 3/24; E04G 2005/008

See application file for complete search history.

(56) References Cited

U.S. PATENT DOCUMENTS

| | | | | |
|---|---|---|---|---|
| 2,066,984 A * | 1/1937 | Lamb | E04G 5/062 182/113 |
| 3,498,375 A | 3/1970 | McEwen et al. | |
| 3,718,266 A * | 2/1973 | Donnally | E21B 15/00 104/121 |
| 3,902,554 A * | 9/1975 | Hooper | E21B 15/02 114/264 |
| 4,007,782 A | 2/1977 | Nybo et al. | |
| 4,108,318 A * | 8/1978 | Rode | E21B 19/002 212/307 |
| 4,230,190 A * | 10/1980 | Guinn | E21B 3/045 166/368 |
| 4,359,089 A | 11/1982 | Strate et al. | |
| 5,121,793 A | 6/1992 | Busch et al. | |

(Continued)

OTHER PUBLICATIONS

Schlumberger Oilfield Glossary entries for "annular BOP", "BOP", "BOP stack", "mud return line", "ram BOP", "rotating control device", and "snubbing", accessed Mar. 2, 2019 via www.glossary.oilfield.slb.com.*

*Primary Examiner* — Blake E Michener
(74) *Attorney, Agent, or Firm* — Rachel E. Greene

(57) ABSTRACT

A multi-level deck system for a blowout preventer and a method, of which the system includes a first deck positioned at least partially around and coupled to the blowout preventer, a second deck positioned at least partially around and coupled to the blowout preventer and vertically spaced apart from the first deck, and a third deck positioned at least partially around the blowout preventer and vertically spaced apart from the second deck.

20 Claims, 7 Drawing Sheets

(56) References Cited

U.S. PATENT DOCUMENTS 5,299,653 A * 4/1994 Nebel ..... B66F 11/044 182/113
5,407,302 A * 4/1995 Springett ..... E02B 17/00 405/196
5,704,427 A * 1/1998 Buck ..... E21B 15/02 166/338
5,816,565 A 10/1998 McGuffin
5,845,708 A * 12/1998 Burge ..... B65H 51/14 166/77.3
5,954,305 A * 9/1999 Calabro ..... H01Q 1/1242 248/219.4
5,957,431 A 9/1999 Serda, Jr.
6,053,255 A 4/2000 Crain
6,079,490 A 6/2000 Newman
6,276,450 B1 8/2001 Seneviratne
6,494,268 B1 * 12/2002 Ljungdahl ..... E21B 19/002 166/339
6,681,894 B1 * 1/2004 Fanguy ..... E04G 1/36 182/113
6,848,539 B2 * 2/2005 Lee ..... E04G 1/36 182/113
6,902,007 B1 * 6/2005 Orr ..... E21B 19/00 166/379
6,955,223 B2 * 10/2005 Orr ..... E21B 19/002 166/360
7,040,411 B2 * 5/2006 Kainer ..... E21B 19/00 166/379
7,073,592 B2 * 7/2006 Polsky ..... E21B 15/003 166/360
7,086,474 B1 * 8/2006 Trevithick ..... E21B 19/00 166/379
7,389,820 B2 * 6/2008 Day ..... E21B 15/045 166/379
7,469,749 B2 * 12/2008 Folk ..... E21B 7/02 166/379
7,896,083 B2 * 3/2011 Vickery ..... E21B 33/03 166/379
8,235,126 B2 * 8/2012 Bradley ..... E21B 41/00 166/379
8,347,983 B2 * 1/2013 Hoyer ..... E21B 21/00 175/22
8,770,298 B2 * 7/2014 Gustafson ..... E21B 41/0021 166/359
8,938,930 B2 * 1/2015 Bryant, Jr. ..... E21B 15/00 166/349
8,997,878 B2 * 4/2015 Brown ..... E21B 19/004 166/341
9,080,336 B1 * 7/2015 Yantis ..... E04G 3/24
9,416,600 B2 * 8/2016 Golovinskij ..... E02B 17/021
9,488,023 B2 * 11/2016 Vogt ..... F16M 1/00
9,500,040 B2 * 11/2016 Holst ..... E21B 33/06
9,580,977 B2 * 2/2017 Vogt ..... E21B 33/06
9,689,233 B2 * 6/2017 Nguyen ..... E21B 33/06
9,738,199 B2 * 8/2017 Shamas ..... F16M 11/04
10,072,465 B1 * 9/2018 Olivier ..... E04G 3/24
2003/0221822 A1 * 12/2003 Polsky ..... E21B 15/003 166/85.4
2004/0011592 A1 * 1/2004 Lee ..... E04G 1/36 182/187
2004/0231857 A1 11/2004 Kainer et al.
2007/0193749 A1 * 8/2007 Folk ..... E21B 7/02 166/379
2009/0151955 A1 * 6/2009 Bamford ..... E21B 3/045 166/335
2010/0224357 A1 * 9/2010 Rodgers ..... E21B 19/00 166/77.4
2011/0036662 A1 * 2/2011 Smith ..... E04G 1/36 182/37
2011/0100637 A1 * 5/2011 Gustafson ..... E21B 33/064 166/359
2011/0253476 A1 * 10/2011 Earl ..... B66F 7/02 182/69.6
2011/0266002 A1 * 11/2011 Singh ..... E21B 33/0355 166/339
2011/0266003 A1 * 11/2011 Singh ..... E21B 33/064 166/368
2012/0318520 A1 * 12/2012 Lugo ..... E21B 21/001 166/363
2015/0376907 A1 * 12/2015 Nguyen ..... E21B 33/06 182/222
2017/0335637 A1 * 11/2017 Nelsen ..... B66C 1/44

* cited by examiner

MULTI-LEVEL DECK SYSTEM FOR BLOWOUT PREVENTERS

BACKGROUND

Blowout preventers (BOPs) provide a variety of safety and sealing functions for a well as part of the drilling process. In land-based drilling, the BOPs are typically positioned below the drilling floor. A deck, commonly referred to as a "Texas deck," can be provided adjacent to or around the BOPs, facilitating human access to the various components of the BOP. The deck is typically suspended or otherwise connected to the rig structure, e.g., the drill floor.

Recently, there has been a shift to movable or "walking" rigs that support pad drilling of several wells in a location. Such walking rigs can, for example, drill a well or a section of a well, and then move independently of external drivers to a different location and drill another well (or section). This is referred to as "pad drilling."

The BOPs are typically moved when the rig moves. Moving the BOP generally includes disassembling the Texas deck, and then re-assembling the Texas deck once the BOP is positioned at the next well location. In applications where several (or dozens or more) wells may be drilled by walking the rig from one site to another on a pad, the rig-up time associated with disassembling and re-assembling the Texas deck can be substantial.

SUMMARY

Embodiments of the disclosure may provide a multi-level deck system for a blowout preventer. The system includes a first deck positioned at least partially around and coupled to the blowout preventer, a second deck positioned at least partially around and coupled to the blowout preventer and vertically spaced apart from the first deck, and a third deck positioned at least partially around the blowout preventer and vertically spaced apart from the second deck.

Embodiments of the disclosure may further provide a blowout preventer assembly that includes a blowout preventer comprising a stack of components, a first deck coupled to the blowout preventer between first and second components of the stack of components, a second deck coupled to a third component of the stack of components, and a third deck positioned at least partially around a fourth component of the stack of components.

Embodiments of the disclosure may also provide a method that includes supporting a blowout preventer in a horizontal configuration using a movable BOP handler. First, second, and third decks are positioned at least partially around and secured to the blowout preventer in the horizontal configuration. The method also includes raising the blowout preventer from the horizontal configuration to a vertical configuration using the movable BOP handler. The first, second, and third decks remain secured to the blowout preventer in the vertical configuration. The method further includes connecting the blowout preventer to a wellhead.

BRIEF DESCRIPTION OF THE DRAWINGS

The present disclosure may best be understood by referring to the following description and accompanying drawings that are used to illustrate one or more embodiments. In the drawings.

DETAILED DESCRIPTION

Figure 1:
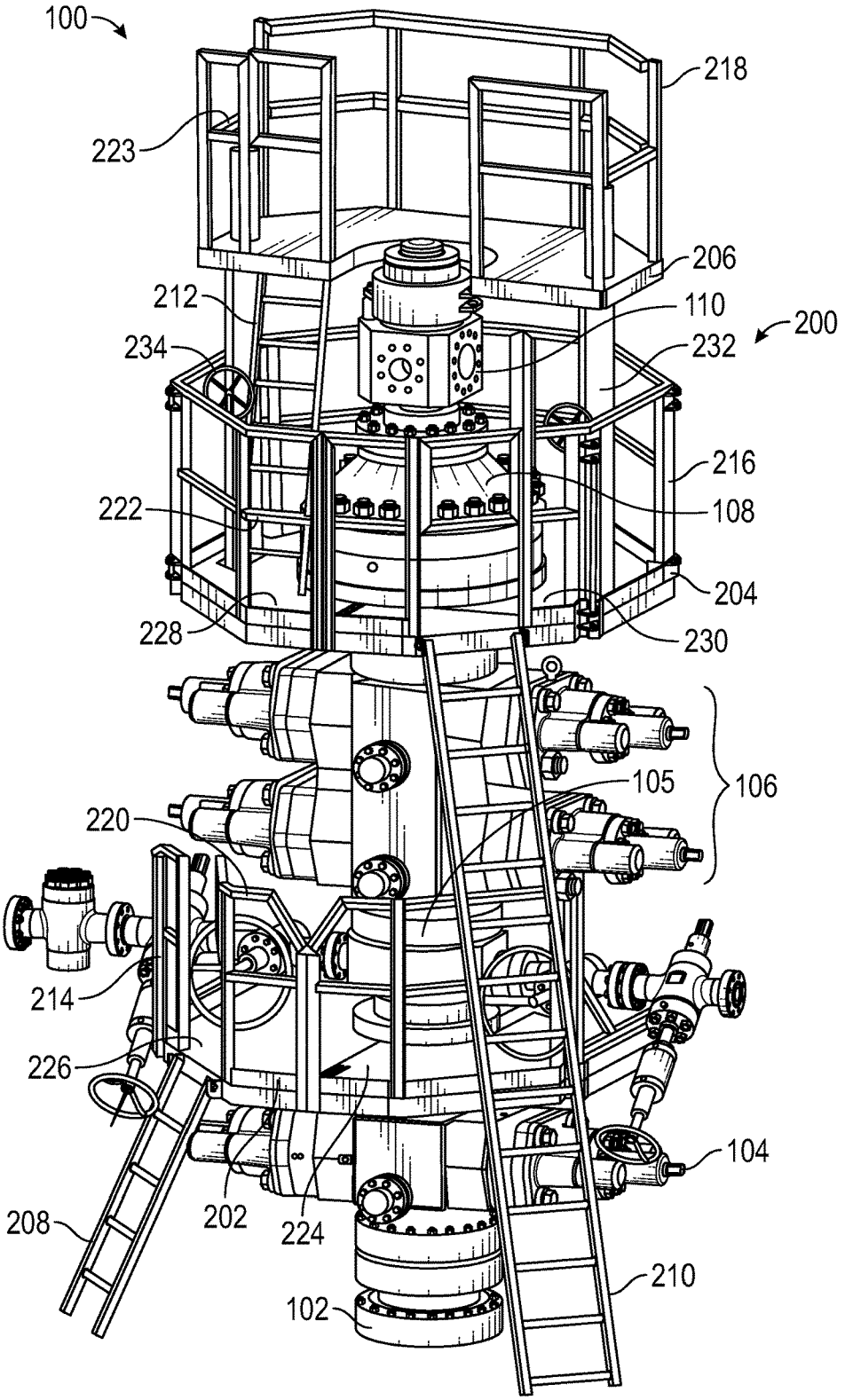
FIG. 1 illustrates a perspective view of a blowout preventer in a vertical configuration having attached a multi-level deck system coupled thereto, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a perspective view of a blowout preventer 100 in a vertical configuration, and a multi-level deck system 200 coupled thereto, according to an embodiment. The blowout preventer 100 may be configured in any suitable manner, and may include a plurality of safety and/or sealing devices. For example, the illustrated, example blowout preventer 100 may include a stack of components including a bottom connector 102 for connecting to a wellhead, a single ram 104, a mud cross-over 105 a double ram 106, an annular seal (or "annular") 108, and a rotating control device 110. The blowout preventer 100 may be configured to connect to a wellhead at the bottom connector 102 and may be positioned below a floor of a drilling rig.

The multi-level deck system 200 may be connected to any of the components of the blowout preventer 100, so as to allow access to the various components thereof, e.g., for maintenance purposes. For example, the multi-level deck system 200 may include a first or "lower" deck 202, which may be coupled to and positioned at least partially around the blowout preventer 100, e.g., between the single ram 104 and the mud cross-over 105, below the double ram 106. The multi-level deck system 200 may also include a second or "middle" deck 204, which may be coupled to and positioned at least partially around the blowout preventer 100, e.g., above the double ram 106, at the base of the annular 108. The multi-level deck system 200 may further include a third or "upper" deck 206, which may be positioned at least partially around the blowout preventer 100, e.g., around the rotating control device 110, or may be positioned farther upward, away from the middle deck 204, to allow access to flow lines along the bottom of the drilling rig floor. The upper deck 206 may be supported by the middle deck 204, as will be explained in greater detail below.

In at least one embodiment, the decks 202, 204, 206 of the multi-level deck system 200 may not be connected to the rig floor, but rather may be connected to (either directly or indirectly) to the blowout preventer 100. Further, the decks 202, 204, 206 may be vertically spaced apart, e.g., to allow access and movement of a human user on each of the decks 202, 204, 206. It will be appreciated that although the illustrated embodiment of the multi-level deck system 200 includes three decks, this is not to be considered limiting; indeed, two, three, four, five, or more decks may be employed in various embodiments of the multi-level deck system 200.

Further, each of the decks 202, 204, 206 may be accessible from the ground via an access ladder 208, 210, 212. The access ladders 208, 210 for the lower and middle decks 202, 204 may extend to the ground, while the access ladder 212 for the upper deck 206 may extend to the middle deck 204. Each of the decks 202, 204, 206 may also include a safety rail 214, 216, 218, respectively. Further, the lower, middle and upper decks 202, 204 and 206 may include safety gates 220, 222, 223 respectively.

The lower and middle decks 202, 204 may each include two pivotal sections, e.g., pivotal sections 224, 226 for the lower deck 202, and pivotal sections 228, 230 for the middle deck 204. The pivotal sections 224, 226 and 228, 230 may be pivotal with respect to one another, and may be latched together, so as to secure together and selectively allow the pivotal sections 224, 226, 228, 230 to swing away from one another. The gates 220, 222 may be positioned at an interface between the pivotal sections 224, 226, so as to allow the safety rails 214, 216 to separate when the pivotal sections 224, 226 and 228, 230 pivot apart.

As shown, the upper deck 206 may be generally semi-circular in shape, with half of its circumference truncated. Accordingly, when being configured for transportation, to avoid exceeding regulatory height and/or width regulations, the gates 220, 222 may be released, and the pivotal sections 224, 226, 228, 230 pivoted away from one another, thereby collapsing the lower and/or middle decks 202, 204. As such, the multi-level deck system 200 may be reduced in size in at least one dimension (as pictured, front to back). In some embodiments, the upper deck 206 may also include such pivotal sections to reduce the dimensions thereof, e.g., for transport. Further, in some embodiments, the lower, middle, and/or upper decks 206 may include three or more pivotal sections.

The upper deck 206 may be connected to the middle deck 204 via posts 232. The posts 232 may have a fixed length in some embodiments, but in other embodiments, may be extendible supports. For example, the posts 232 may be extendible hydraulically as by a screw jack 234 or another device configured to adjust the distance between the middle and upper decks 204, 206. Such variable distance between the middle and upper decks 204, 206 may facilitate movement along the middle deck 204 (e.g., providing increased clearance) and/or may facilitate accessing higher or lower components via the upper deck 206.

Figure 2:
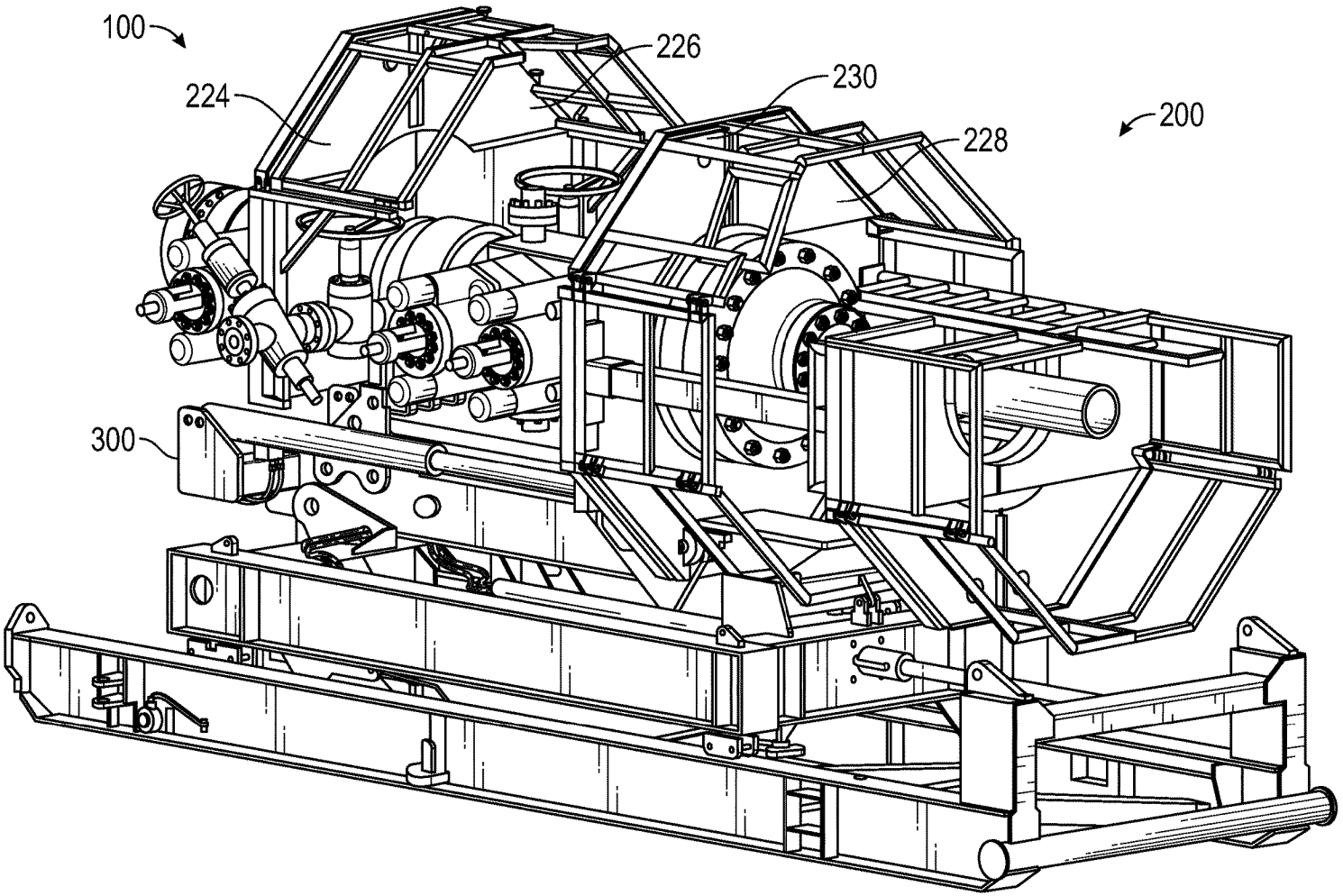
FIG. 2 illustrates a perspective view of a blowout preventer assembly including a blowout preventer in a horizontal configuration, supported on a BOP handler, and the multi-level deck system, according to an embodiment.

FIG. 2 illustrates a perspective view of a blowout preventer assembly including the blowout preventer 100 in a horizontal configuration, and a BOP handler 300 supporting the blowout preventer 100, according to an embodiment. As can be seen, the multi-level deck system 200 remains attached to the blowout preventer 100 in the horizontal configuration. Further, the blowout preventer 100 in the horizontal configuration, supported on the BOP handler 300, is ready to be moved, e.g., along with a movable rig (e.g., a self-moving rig, such as a sliding or "walking" rig). For example, the BOP handler 300 may be attached to base boxes of a land rig, such that the BOP handler 300 moves along with the base boxes.

As can also be seen in FIG. 2, the pivotal sections 224, 226, 228, 230 may remain connected together when the blowout preventer 100 is in the horizontal configuration. The pivotal sections 224, 226, 228, 230 can also be pivoted away from one another to reduce the dimension (as shown, height from top to bottom) of the multi-level deck system 200. Further, in some embodiments, the pivotal sections 224, 226, 228, 230 can be separated proximal to the BOP handler 300 (e.g., on the bottom side, as shown), so as to allow clearance for a lifting frame of the BOP handler 300, e.g., allowing the lifting frame to move past the lower and middle decks 202, 204 unobstructed.

Figure 3:
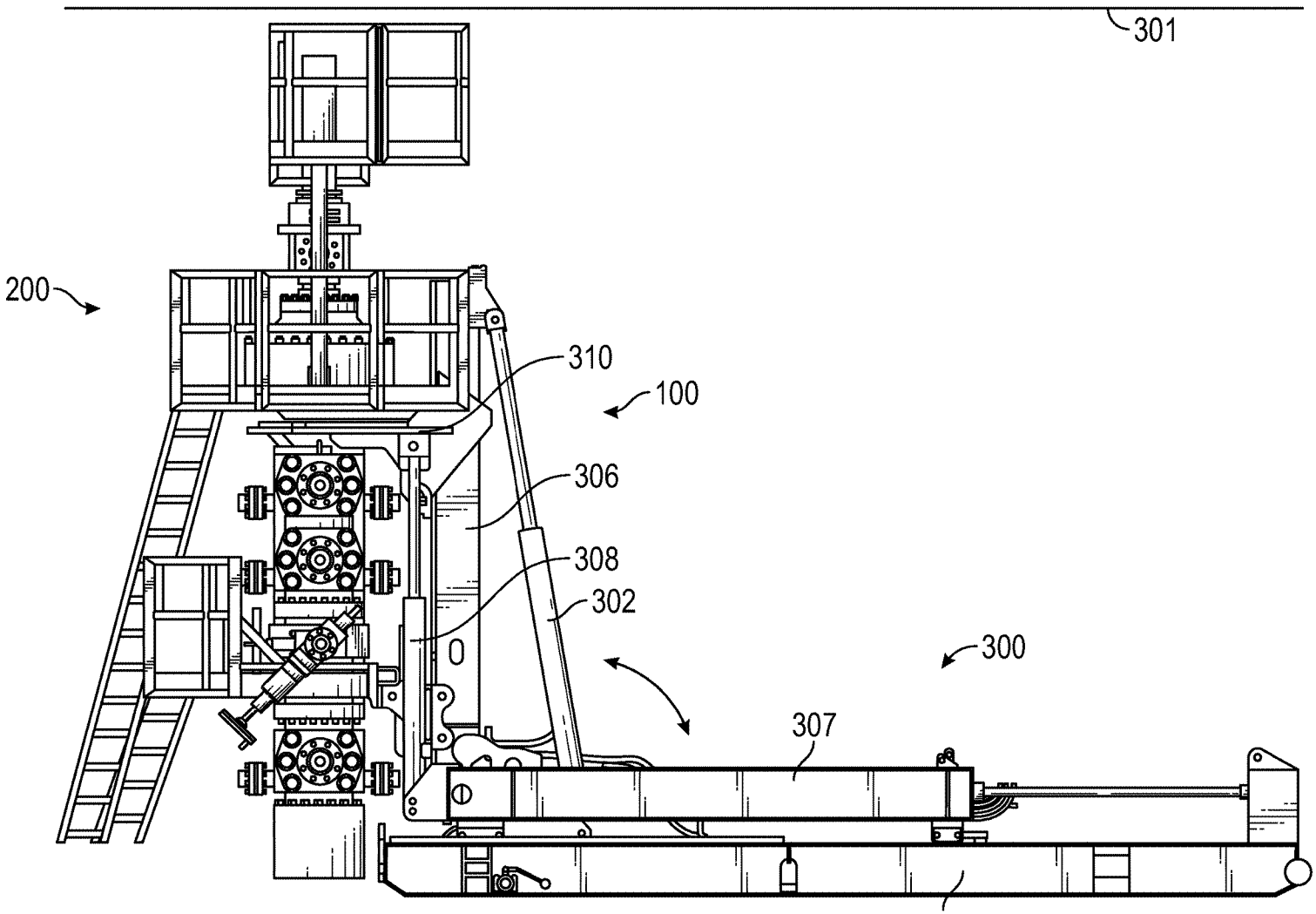
FIG. 3 illustrates a side, elevation view of the blowout preventer in the vertical configuration, supported by the BOP handler, and illustrates the BOP handler moving the blowout preventer between the vertical and horizontal configurations, according to an embodiment.

FIG. 3 illustrates a side, elevation view of the blowout preventer 100 being raised (pivoted from horizontal to vertical) into the vertical configuration by the BOP handler 300, while connected to the multi-level deck system 200, according to an embodiment. In this vertical configuration, the blowout preventer 100 may be raised off the wellhead and supported by the BOP handler 300. The rig to which the BOP handle 300 is attached may commence walking, and the blowout preventer 100 may remain in the vertical configuration during such for rig walking. For reference, the bottom of the drill floor 301 is schematically illustrated in FIG. 3 above the upper deck 206.

Figure 4:
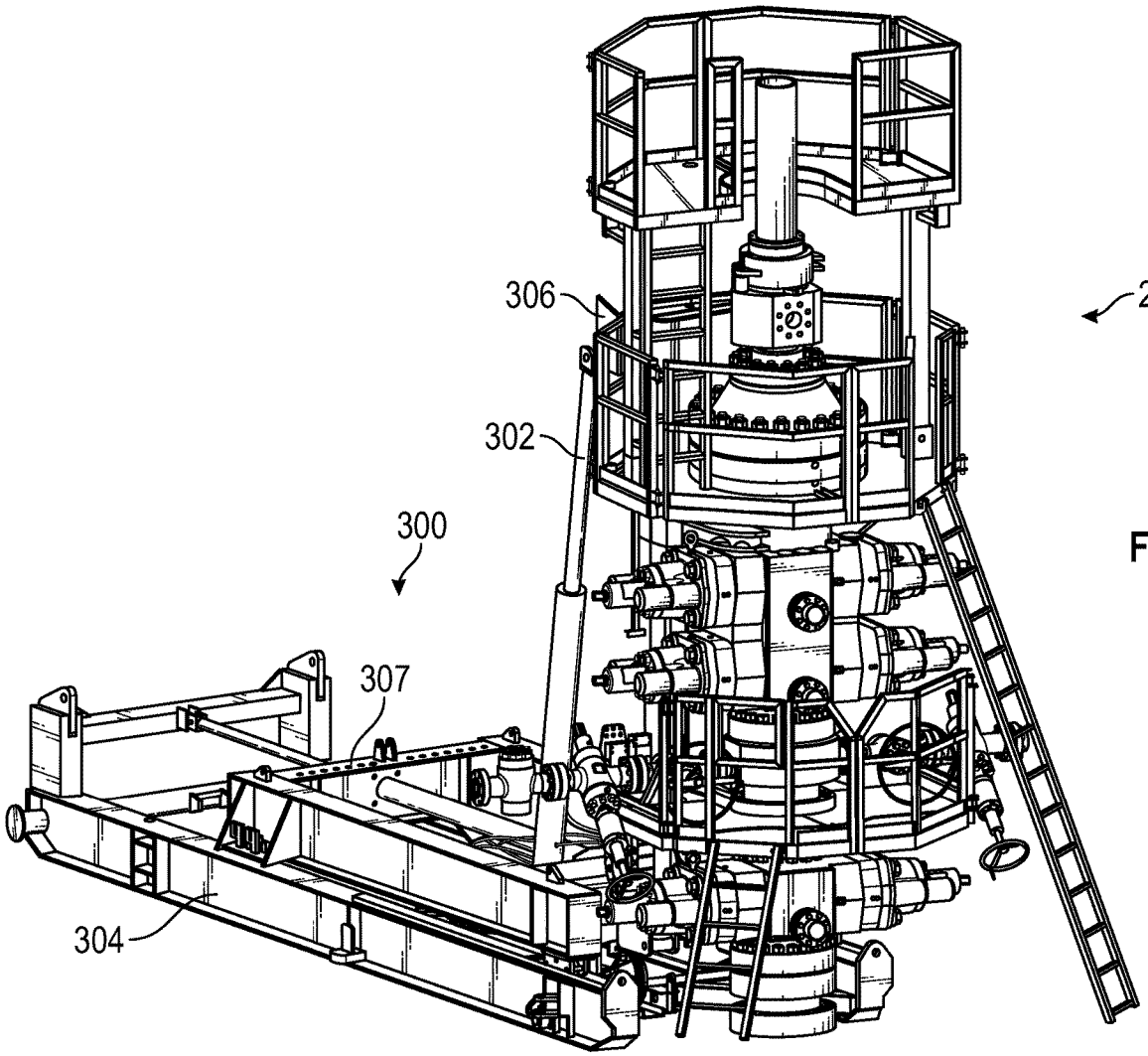
FIG. 4 illustrates another perspective view of the blowout preventer with the multi-level deck system, in the vertical configuration, supported by the BOP handler, according to an embodiment.

FIG. 4 illustrates a perspective view of the blowout preventer 100, the multi-level deck system 200, and the BOP handler 300, according to an embodiment. Referring to both FIGS. 3 and 4, a variety of different types of BOP handlers 300 are known and may be employed consistent with the present disclosure. For example, the BOP handler 300 may include one or more (e.g., hydraulic) raising frames 306 attached to a carriage frame 307 and a transport skid frame 304. The BOP handler 300 may also include one or more raising cylinders 302 that, when extended, pivot the lifting frame 306 from horizontal (e.g., generally perpendicular to the base frame 304) to vertical, as shown. As mentioned above, the pivotal sections 224, 226, 228, 230 (e.g., FIG. 2) may be pivotal to allow for clearance of the lifting frame 306.

The BOP handler 300 includes a carriage frame 307 that is movable horizontally along the base frame 304. The BOP handler 300 may also include second lifting cylinders 308 (FIG. 3), which may extend from the carriage 307 to an engaging device (e.g., a wrench) 310 that serves to connect to the blowout preventer 100. The carriage 307 and the second lifting cylinders 308 may operate to manipulate the engaging device 310, and thus the blowout preventer 100 when connected thereto, in the horizontal and vertical axes, respectively, thereby allowing for positioning the blowout preventer 100 at a well, and removing the blowout preventer 100 therefrom.

Figure 5:
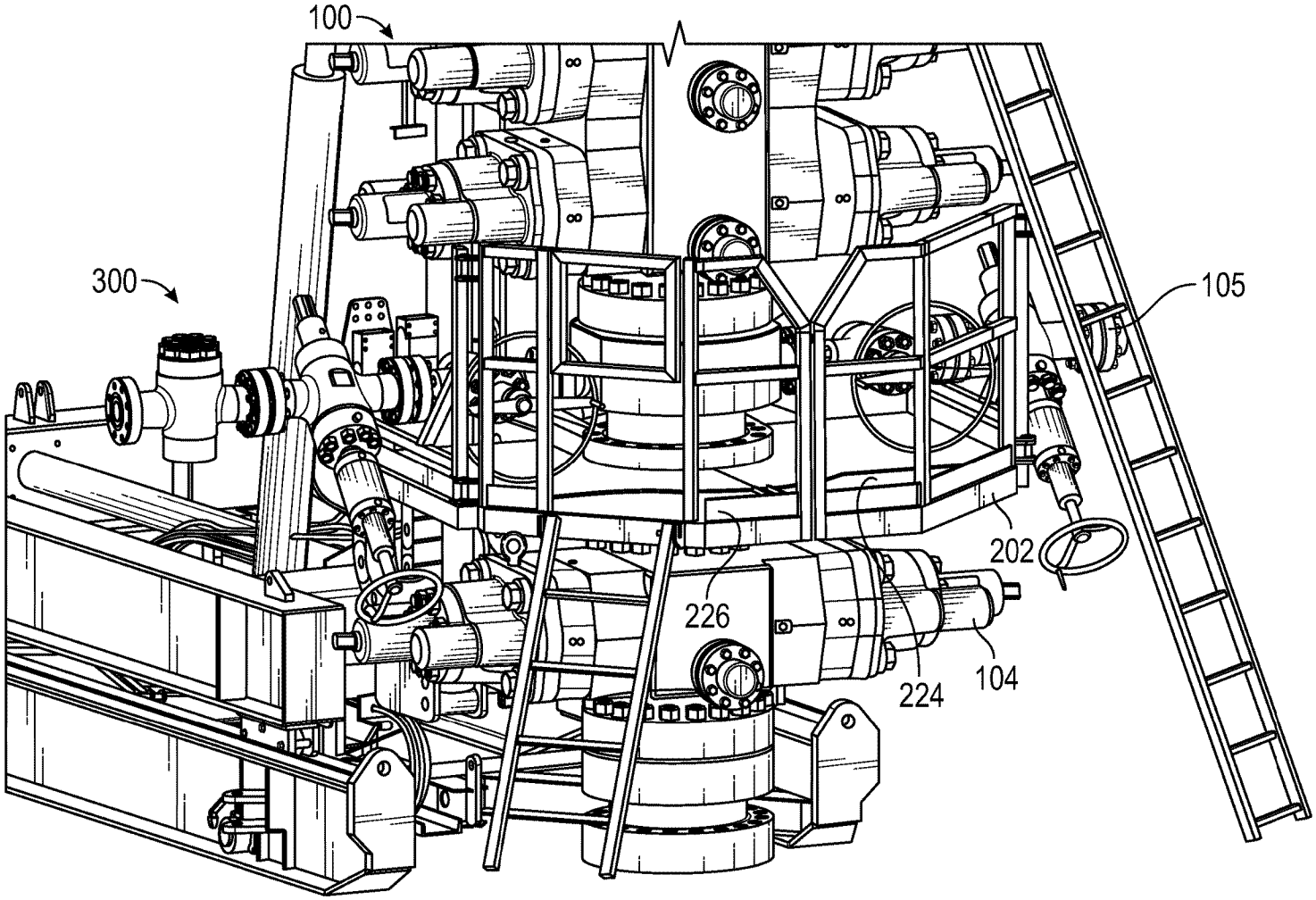
FIG. 5 illustrates an enlarged, perspective view of a lower deck of the multi-level deck system for the blowout preventer, according to an embodiment.

FIG. 5 illustrates an enlarged, perspective view of the lower deck 202 of the system 200 and a portion of the blowout preventer 100 and the BOP handler 300, according to an embodiment. The pivotal sections 224, 226 are shown, as is the connection with the blowout preventer 100 between the single ram 104 and the mud cross-over 105.

Figure 6:
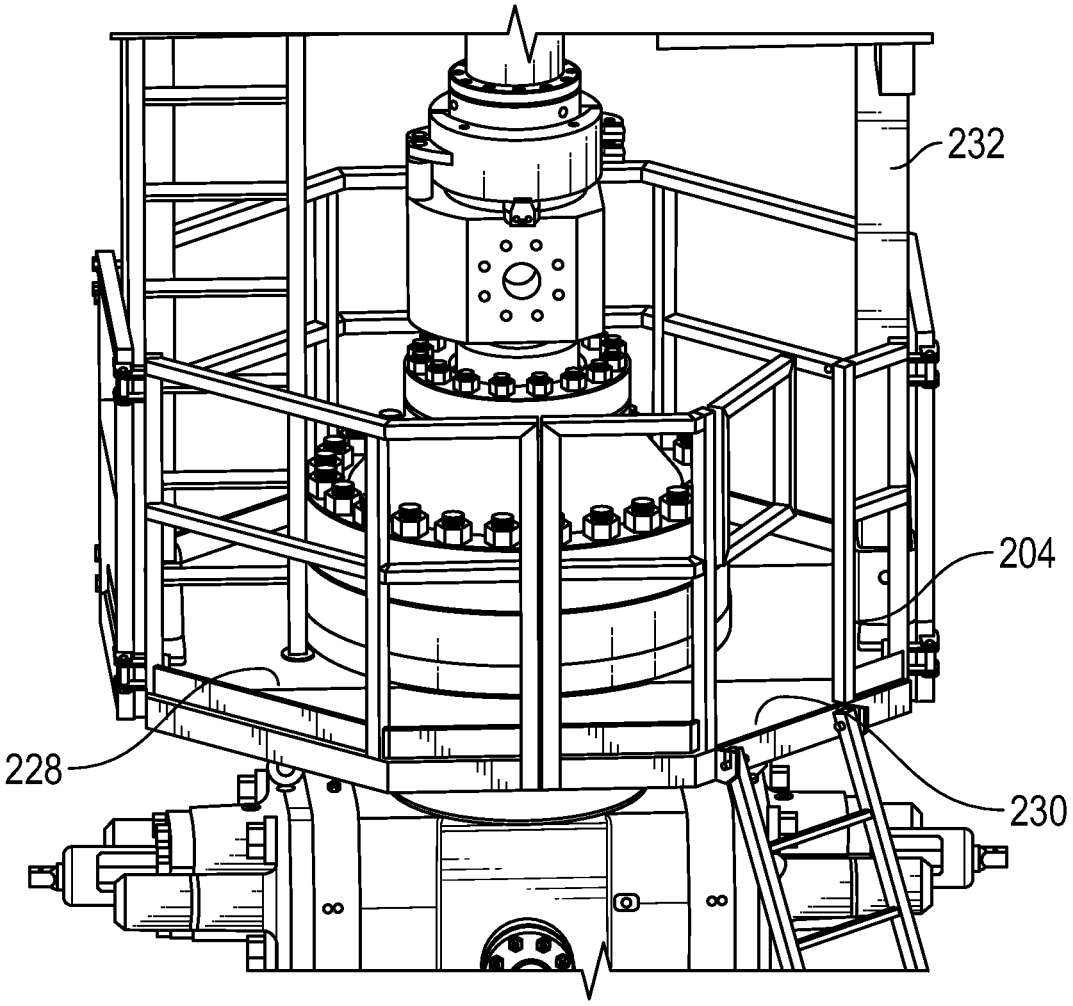
FIG. 6 illustrates an enlarged, perspective view of a second or "middle" deck of the multi-level deck system for the blowout preventer, according to an embodiment.

FIG. 6 illustrates an enlarged, perspective view of the middle deck 204 of the system 200, and a portion of the blowout preventer 100, according to an embodiment. As shown, the pivotal sections 228, 230 are connected to the circumference of the annular 108, allowing for easy access thereto from the middle deck 204. Further, the posts 232 that support the upper deck 206 (see, e.g., FIG. 1) are also illustrated.

Figure 7:
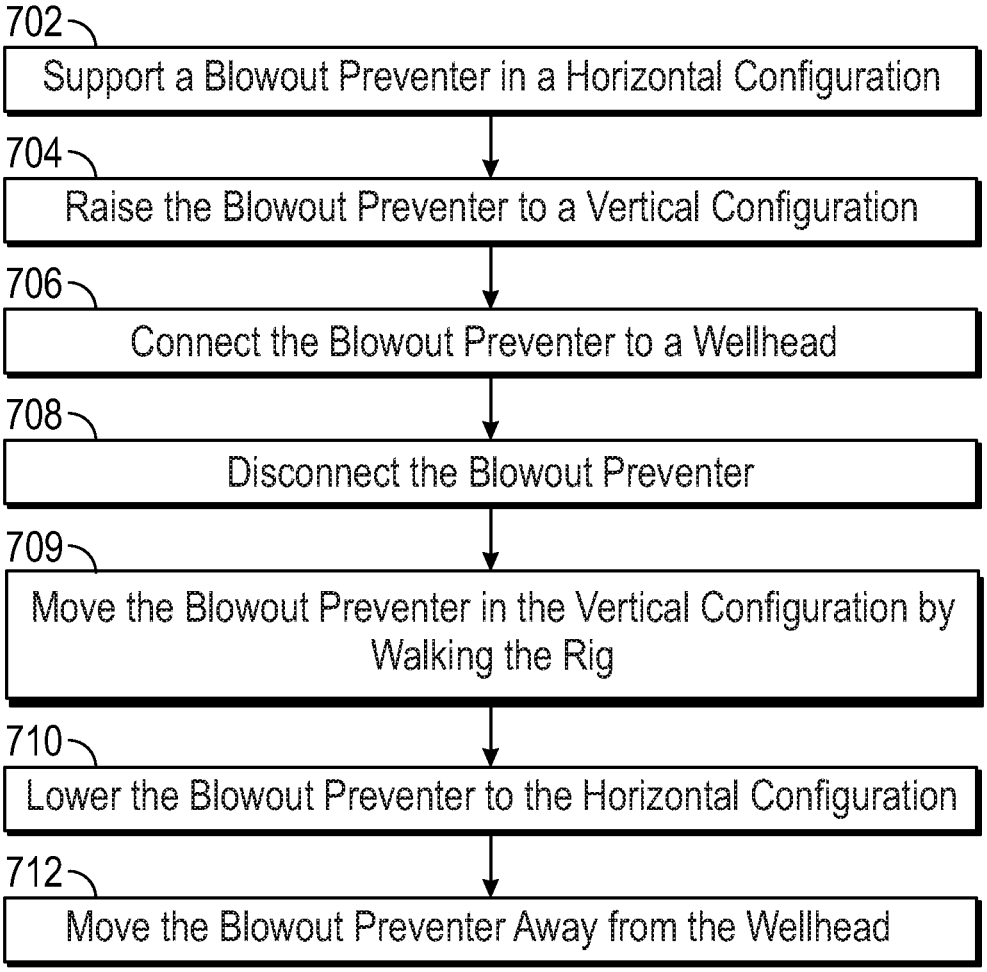
FIG. 7 illustrates a flowchart of a method for accessing and moving a blowout preventer, according to an embodiment.

FIG. 7 illustrates a flowchart of a method 700, e.g., for providing access to a blowout preventer as part of a walking rig, according to an embodiment. The method 700 may be understood with reference to the blowout preventer 100, multi-level deck system 200, and BOP handler 300 discussed above, but it will be appreciated that at least some embodiments of the method 700 may employ other structures, and thus the method 700 should not be limited to any specific structure unless otherwise stated herein.

Accordingly, referring to FIGS. 1-6 where appropriate, the method 700 may include supporting a blowout preventer 100 in a horizontal configuration (see, e.g., FIG. 2) using a movable BOP handler 300, as at 702. First, second, and third (e.g., lower, middle, and upper, respectively) decks 202, 204, 206 are positioned at least partially around and secured to the blowout preventer 100 in the horizontal configuration.

The method 700 may also include raising the blowout preventer 100 from the horizontal configuration to a vertical configuration (e.g., FIG. 3) using the movable BOP handler 300, as at 704. Such raising may be accomplished by pivoting the blowout preventer 100 using a lifting assembly (e.g., a hydraulic lifting assembly) of the BOP handler 300, as described above. The first, second, and third decks 202, 204, 206 may remain secured to the blowout preventer 100 in the vertical configuration, e.g., before, during, and after movement from the horizontal configuration to the vertical configuration.

Once the blowout preventer 100 is in the vertical configuration, the method 700 may include connecting the blowout preventer 100 to a wellhead, as at 706, e.g., using the bottom connector 102. The BOP handler 300 may be employed to accomplish this by including a hydraulic lifting assembly configured to move the blowout preventer 100 vertically and horizontally, e.g., while in the vertical configuration, into position at the wellhead, as described above.

In an embodiment, to move the blowout preventer 100 from one wellsite to another (e.g., when walking the rig), the method 700 may include disconnecting the blowout preventer 100 from the wellhead, as at 708. The method 700 may include moving the blowout preventer 100 by walking the rig, while the BOP handler 300 supports the blowout preventer 100 in the vertical configuration, as at 709. The method 700 may also include lowering the blowout preventer 100 from the vertical configuration to a horizontal configuration, as at 710. The first, second, and third decks 202, 204, 206 may remain secured to the blowout preventer 100 in the horizontal configuration, e.g., before, during, and after lowering the blowout preventer 100. The method 700 may also include moving the blowout preventer 100 away from the wellhead by moving the BOP handler 300 (e.g., by connection to a base box or another part of the substructure of a walking rig), as at 712.

In an embodiment, the method 700 further includes raising or lowering the third deck relative to the second deck, e.g., when in the vertical configuration. For example, the second deck 204 may be positioned above the first deck 202, and the third deck 206 may be positioned above the second deck 204.

In an embodiment, the method 700 may include pivoting apart pivotal sections 224, 226 of the first deck 202 to reduce a dimension of the first deck 202 for transport, while the first deck 202 is (and/or any other decks are) secured to the blowout preventer 100.

In an embodiment, the method 700 may also include pivoting apart pivotal sections 224, 226 of the first deck 202 to allow for clearance of a lifting frame 306 of the BOP handler 300. Further, the method 700 may include lifting the blowout preventer 100 using the raising frame 306 of the BOP handler 300.

In an embodiment, the method 700 may include accessing the first, second, and/or third decks 202, 204, 206 from a ground below a drilling rig floor, e.g., by climbing up the ladders 208, 210, 212.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial configuration. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A blowout preventer system comprising:

a blowout preventer;

a first deck positioned at least partially around and directly coupled to the blowout preventer;

a second deck positioned at least partially around and directly coupled to the blowout preventer and spaced apart from the first deck; and a third deck positioned at least partially around the blowout preventer and spaced apart from the second deck, wherein the second deck is vertically between the first deck and the third deck when the system is in a vertical configuration, and wherein the third deck is supported in position relative to the blowout preventer by a support extending between the first and second decks.

2. The system of claim 1, wherein the support comprises an extendible support connected to the second deck and the third deck, wherein the extendible support is configured to vary a distance between the second and third decks.

3. The system of claim 1, wherein none of the first, second, or third decks are directly connected to a rig floor that is vertically above the third deck when the first, second, and third decks are in the vertical configuration.

4. The system of claim 1, wherein at least one of the first, second, and third decks comprises two or more pivotal sections that when pivoted together, form a platform, and are configured to pivot apart to reduce a dimension of the at least one of the first, second and third decks.

5. The system of claim 1, wherein the first deck is connected to the blowout preventer between a first ram and a mud cross-over, the second deck is connected to a housing of an annular seal of the blowout preventer, and wherein the third deck is positionable at least partially around a rotating control device of the blowout preventer.

6. A blowout preventer assembly, comprising:

a blowout preventer comprising a stack of components;

a first deck coupled to the blowout preventer by attachment to the blowout preventer at a position between first and second components of the stack of components;

a second deck coupled to the blowout preventer by attachment to a third component of the stack of components; and a third deck positioned at least partially around a fourth component of the stack of components, wherein the third deck is supported in position relative to the blowout preventer by connection to the second deck.

7. The assembly of claim 6, further comprising a BOP handler configured to couple to the blowout preventer and pivot the blowout preventer between a horizontal configuration and a vertical configuration, wherein the first, second, and third decks remain coupled to the blowout preventer in the horizontal configuration and in the vertical configuration.

8. The assembly of claim 7, wherein at least the first deck includes a plurality of pivotal sections, wherein, when the plurality of pivotal sections are pivoted together, the plurality of pivotal sections form a platform of the first deck, and wherein, when the pivotal sections are pivoted apart from one another, the pivotal sections allow passage of a lifting frame of the BOP handler past the first deck, such that the lifting frame is engageable with the blowout preventer.

9. The assembly of claim 8, wherein the plurality of pivotal sections are pivotal to reduce a dimension of the first deck during transport.

10. The assembly of claim 7, wherein:

the first component comprises a first ram;

the second component comprises a mud cross-over;

the third component comprises a housing of an annular seal; and the fourth component comprises a rotating control device.

11. The assembly of claim 7, wherein a distance between the second deck and the third deck is adjustable.

12. The assembly of claim 7, further comprising one or more posts connected to the second and third decks, so as to support the third deck by connection to the second deck.

13. The assembly of claim 12, wherein the posts are extendible so as to adjust a distance between the second and third decks.

14. A method, comprising:

supporting a blowout preventer in a horizontal configuration using a movable BOP handler, wherein first, second, and third decks are positioned at least partially around the blowout preventer in the horizontal configuration, wherein the first and second decks are directly coupled to the blowout preventer, the second deck is between the first and third decks, and the third deck is not directly coupled to the blowout preventer and is directly coupled to the second deck by a support extending therebetween;

raising the blowout preventer from the horizontal configuration to a vertical configuration using the movable BOP handler, wherein the first and second decks remain directly coupled to the blowout preventer in the vertical configuration; and connecting the blowout preventer to a wellhead.

15. The method of claim 14, further comprising:

disconnecting the blowout preventer from the wellhead; and moving the blowout preventer away from the wellhead by moving the BOP handler while the blowout preventer is in the vertical configuration.

16. The method of claim 15, further comprising lowering the blowout preventer from the vertical configuration to the horizontal configuration, wherein the first, second, and third decks remain secured to the blowout preventer when the blowout preventer is lowered to the horizontal configuration.

17. The method of claim 14, further comprising raising or lowering the third deck relative to the second deck, wherein, when the blowout preventer is in the vertical configuration, the second deck is positioned above the first deck, and the third deck is positioned above the second deck.

18. The method of claim 14, further comprising pivoting apart pivotal sections of the first deck to reduce a dimension of the first deck for transport, while the first deck is secured to the blowout preventer.

19. The method of claim 14, further comprising:

pivoting apart pivotal sections of the first deck to allow for clearance of a lifting frame of the BOP handler, wherein, when the pivotal sections are pivoted together, the pivotal sections for a platform; and lifting the blowout preventer in the vertical configuration using the lifting frame of the BOP handler, wherein the lifting frame extends past the pivoted-apart sections of the first deck.

20. The method of claim 14, further comprising accessing the first and second decks from a ground that is at a lower elevation than drilling rig floor.

* * * * *